US008381352B2

(12) United States Patent
Huffman et al.

(10) Patent No.: US 8,381,352 B2
(45) Date of Patent: Feb. 26, 2013

(54) EXTRACTION WITH TEMPORARY SUCTION INTERRUPT

(75) Inventors: Eric C. Huffman, Lowell, MI (US); Charles A. Reed, Jr., Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 475 days.

(21) Appl. No.: 12/574,108

(22) Filed: Oct. 6, 2009

(65) Prior Publication Data

US 2011/0079248 A1 Apr. 7, 2011

(51) Int. Cl.
*A47L 7/00* (2006.01)

(52) U.S. Cl. ..... 15/320

(58) Field of Classification Search ..... 15/320
See application file for complete search history.

(56) References Cited

U.S. PATENT DOCUMENTS

| | | | | |
|---|---|---|---|---|
| 5,542,147 | A | 8/1996 | Merten | |
| 6,131,237 | A * | 10/2000 | Kasper et al. | 15/320 |
| 6,658,692 | B2 | 12/2003 | Lenkiewicz et al. | |
| 6,662,402 | B2 | 12/2003 | Giddings et al. | |
| 6,735,812 | B2 | 5/2004 | Hekman et al. | |
| 2003/0024065 | A1 * | 2/2003 | Zahuranec et al. | 15/320 |
| 2005/0132524 | A1 * | 6/2005 | Parr | 15/320 |
| 2007/0226943 | A1 * | 10/2007 | Lenkiewicz et al. | 15/320 |
| 2008/0196193 | A1 | 8/2008 | Huffman et al. | |

FOREIGN PATENT DOCUMENTS

| | | | |
|---|---|---|---|
| WO | 9204854 | A1 | 4/1992 |
| WO | WO 9204854 | A1 * | 4/1992 |

* cited by examiner

*Primary Examiner* — Bryan R Muller
(74) *Attorney, Agent, or Firm* — McGarry Bair PC

(57) ABSTRACT

An extractor has a duct door moveably mounted to a working air conduit for movement between a first position at which normal suction at a suction nozzle is reduced and a second position at which normal suction at the suction nozzle is unreduced. An actuator is connected to the duct door for selectively moving the duct door between the first position and second position. In one embodiment, a suction leak hole is formed within the working air conduit and the duct door is moveable with respect to the leek hole to selectively fluidly open and close the leak hole. In another embodiment, the duct door is moveable within the working air conduit to selectively fluidly restrict the working air flow in the working air conduit and the actuator selectively moves the duct door between the first and second positions. The suction reduction selectively increases the cleaning solution dwell time.

16 Claims, 9 Drawing Sheets

EXTRACTION WITH TEMPORARY SUCTION INTERRUPT

BACKGROUND OF THE INVENTION

1. Field of the Invention

The invention relates to a wet extractor for delivering cleaning fluid to a surface to be cleaned and removing the cleaning fluid from the surface to be cleaned. In one aspect, the invention relates to an apparatus for reducing suction from the suction nozzle to lengthen the dwell time for applied cleaning solution to a surface. In another of its aspects, the invention relates to a method for selectively lengthening the dwell time for cleaning solution that has been applied to a surface.

2. Description of the Related Arts

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system typically comprises a recovery tank, a nozzle adjacent the surface to be cleaned and in fluid communication with the recovery tank through a working air conduit, and a suction source in fluid communication with the working air conduit to draw the cleaning fluid from the surface to be cleaned and through the nozzle and the working air conduit to the recovery tank. Examples of extractors are disclosed in commonly assigned U.S. Pat. No. 6,131,237 to Kasper et al. and U.S. Pat. No. 6,658,692 to Lenkiewicz, which are incorporated herein by reference in their entirety. Vacuum cleaners are also well-known cleaning devices for cleaning a range of items including carpets and drapery. Historically vacuums included a suction-relief vent for reducing the suction power to a suction nozzle.

U.S. Pat. No. 6,662,402 to Giddings et al. discloses a soil transfer extraction cleaning method employing a roller assembly including a soil transfer cleaning medium to mechanically remove soil from the surface to be cleaned. The method includes the steps of successively and repeatedly wetting a portion of the cleaning medium with a cleaning liquid, extracting any soil and at least some of the cleaning liquid from the previously wetted portion of the cleaning medium, and wiping the surface to be cleaned with the cleaning medium so as to transfer soil from the surface to be cleaned to the cleaning medium.

U.S. Pat. No. 6,735,812 to Hekman et al. discloses an apparatus having a cleaning implement in selective wiping contact with the surface to be cleaned; a cleaning solution dispenser that selectively wets a portion of the cleaning implement, a portion of the surface to be cleaned, or both; a first selectively controllable vacuum extractor tool to remove some of the dispensed cleaning solution and soil from the cleaning implement; and a second selectively controllable vacuum extractor tool which removes soil and some of the cleaning solution directly from the surface to be cleaned.

Traditionally, carpet extractors deliver cleaning fluid directly to a surface to be cleaned or onto an agitation system that subsequently delivers the cleaning solution to the surface to be cleaned. In both cases, the surface to be cleaned is saturated with cleaning fluid and allowed to dwell a sufficient amount of time in order to maximize the efficiency of the chemical process. In a second step, the cleaning solution together with any entrained debris is removed from the surface to be cleaned and collected via the fluid recovery system. In some cases it is desirable to increase the dwell time for portions of a carpet that are especially soiled.

SUMMARY OF THE INVENTION

An extractor according to the invention comprises a fluid delivery system including a solution supply tank assembly, a fluid distributor, and a conduit between the fluid tank and the fluid distributor for depositing fluid onto a surface to be cleaned; a fluid recovery system including a floor suction nozzle, a recovery tank assembly, a suction source having a suction inlet fluidly connected to the recovery tank and the suction nozzle through a working air conduit and adapted to draw liquid through the suction nozzle and deposit the liquid in the recovery tank, and having a suction source outlet, a duct door moveably mounted to the working air conduit for movement between a first position at which normal suction at the suction nozzle is reduced and a second position at which normal suction at the suction nozzle is unreduced; and an actuator connected to the duct door for selectively moving the duct door between the first position and second position.

In one embodiment, a leak hole is located in the working air conduit, and the duct door covers the leak hole in the second position and uncovers the leak hole in the first position at which air is vented into the working air conduit. Typically, the duct door comprises a generally planar member having a resilient seal affixed along a perimeter to fluidly seal the leak hole when the duct door is in the second position.

In another embodiment, the duct door has a restriction orifice and is moveably mounted inside the working air conduit for movement between the first position in which the duct door spans across the working air conduit interior and the airflow through the working air conduit is restricted and the second position at which airflow is unrestricted.

Further, a sealing lip is positioned between an inner surface of the working air conduit and the duct door to seal the duct door to the working air conduit when the duct door is in the first position.

In yet another embodiment, the extractor is an upright extractor that includes a foot assembly for movement along the surface to be cleaned and a handle assembly pivotally mounted to the foot assembly for directing the foot assembly along the surface to be cleaned. In this embodiment, the actuator is preferably at least partially located on the handle assembly and the suction source is mounted in the foot assembly.

In another embodiment, the actuator is connected through an electrical connector to the duct door for moving the duct door between the first and second positions. In this embodiment the electrical connector can include a solenoid coupled to the duct door and configured to selectively move the duct door between the first and second positions.

In another embodiment of the invention, the actuator is connected through a mechanical connector to the duct door for moving the duct door between the first and second positions. In this embodiment, the mechanical connector can include a cable connected to the actuator and the duct door.

In still another embodiment, the actuator is connected through a hydraulic connector to the duct door for moving the duct door between the first and second positions. In this embodiment, a hydraulic cylinder can be operably coupled to the duct door and configured to selectively move the duct door between the open and closed positions. Further, the conduit between the fluid tank and the fluid distributor can include the hydraulic cylinder which can be adapted to fluidly couple the solution supply tank to the fluid distributor when the duct door is in the first position and to interrupt the flow of fluid from the fluid tank to the fluid distributor when duct door is in the second position.

In yet another embodiment, the extractor can further include an indicator to alert a user when the duct door is in the open position. The indicator can be a lamp, a light emitting diode (LED), an audible signal or any combination thereof.

Further, according to the invention, a method of cleaning a surface comprises depositing a cleaning fluid onto the surface, extracting the cleaning fluid from the surface with suction and selectively interrupting the suction to the surface for a selected time to increase the dwell time of cleaning fluid on the surface prior to complete extraction of the cleaning fluid from the surface. Preferably, the method comprises restoring suction to the surface after the selected time to remove the cleaning fluid from the surface.

In one embodiment, the method further comprises agitating the surface to be cleaned during the selected time.

DESCRIPTION OF THE PREFERRED EMBODIMENT

Figure 1:
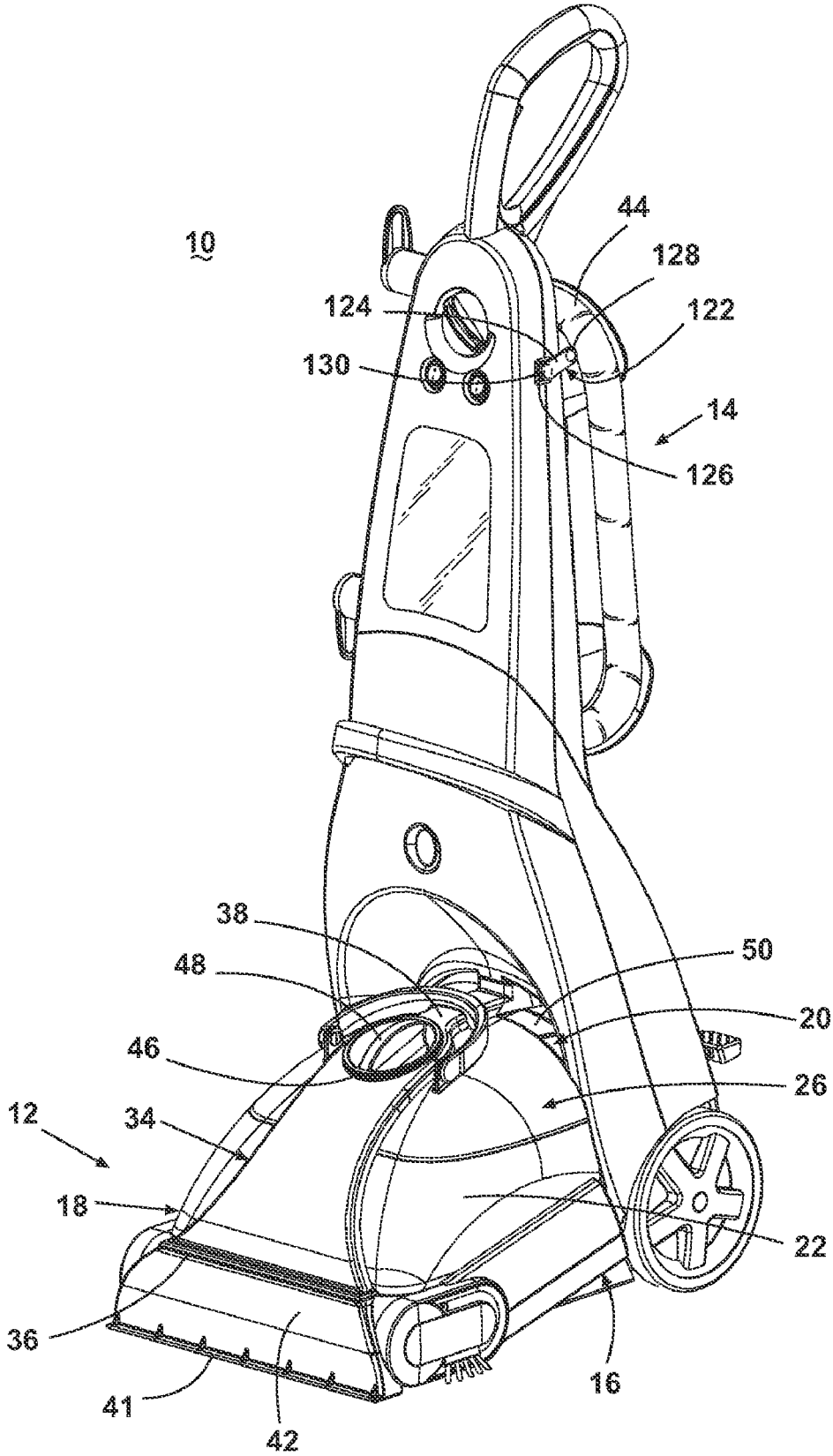
FIG. 1 is a front perspective view of an upright extractor according to the invention.
Figure 2:
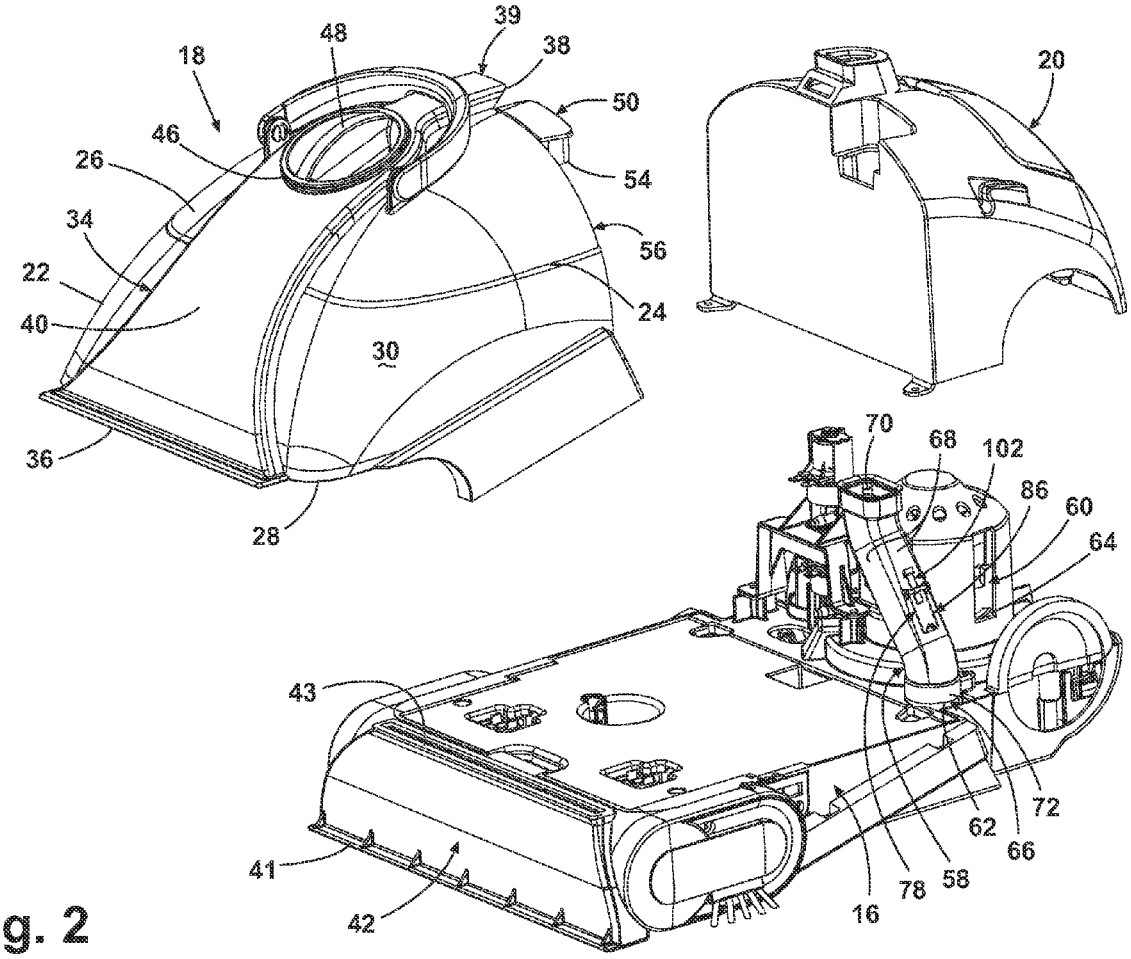
FIG. 2 is a partial exploded perspective view of a foot assembly of the upright extractor of FIG. 1.

Referring to the figures, and particularly to FIGS. 1-2, an upright extractor 10 according to the invention comprises a housing having a foot assembly 12 for movement across a surface to be cleaned and a handle assembly 14 pivotally mounted to the rear of the foot assembly 12 for directing the foot assembly 12 across the cleaning surface. The upright extractor 10 includes a fluid supply system for storing a cleaning fluid and delivering the cleaning fluid to the cleaning surface and a fluid recovery system for removing the spent cleaning fluid and dirt. The fluid supply system includes a solution supply tank assembly 20, a fluid distributor (not shown), and a conduit (not shown) between the solution supply tank assembly 20 and the fluid distributor for depositing fluid onto a surface to be cleaned. The fluid recovery system includes a floor suction nozzle 42, a recovery tank assembly 18, a working air conduit between the suction nozzle 42 and the recovery tank assembly 18, and a motor and fan assembly 60 that acts as a suction source. The working air conduit begins at a tank outlet conduit 50 leading from the internal tank volume and leads to a motor duct 58, which is in fluid communication with the motor and fan assembly 60. The upright extractor 10 also includes an agitation system for agitating the surface to be cleaned. The components of the fluid delivery system and the fluid recovery system are supported by at least one of the foot assembly 12 and the handle assembly 14. Examples of extractors having fluid delivery, fluid recovery, and agitation systems are disclosed in commonly assigned U.S. Pat. No. 6,131,237 to Kasper et al. and U.S. patent application Ser. No. 11/276,167 to Lenkiewicz et al., which are both incorporated herein by reference in their entirety. While illustrated in an upright extractor, it is contemplated that the invention can be used in any type of extractor including canister and handheld extractors.

The foot assembly 12 comprises a base assembly 16 configured to support a recovery tank assembly 18 at a forward portion thereof and the solution supply tank assembly 20 at a rearward portion thereof. The solution supply tank assembly 20 is fluidly connected to a fluid distributor (not shown), and comprises the necessary tubing, valves, pumps, heaters, and spray nozzles for distributing a cleaning fluid onto the surface to be cleaned. The base assembly 16 can also be configured to support a conventional motor-driven brush assembly for agitating the surface to be cleaned.

Referring to FIG. 2, the recovery tank assembly 18 comprises a lower tank housing 22 with an open top 24 covered by a removable lid 26 and a closed bottom 28. A recovery chamber 30 is formed within the lower tank housing 22 and is fluidly connected to a recovery tank inlet (not shown) to receive and store spent cleaning fluid and dirt. The recovery tank assembly 18 comprises a fluid conduit 34 overlying the removable lid 26 and fluidly connects a nozzle conduit inlet 36 originating at a forward nozzle conduit section 40 and an accessory conduit inlet 38 originating at a rearward accessory conduit section 39. When the recovery tank assembly 18 is installed onto the base assembly 16, the nozzle conduit section 40 is fluidly connected to an outlet 43 of a floor nozzle 42 having a nozzle inlet 41 adjacent to the cleaning surface, and the accessory conduit section 39 is in fluid communication with an upholstery hose 44 (FIG. 1). The nozzle conduit section 40 and the accessory conduit section 39 meet at a circular opening 46 formed in the fluid conduit 34. The circular opening 46 opens into the recovery chamber 30 and is in fluid communication with the recovery tank inlet (not shown). A diverter valve 48 is rotatably mounted within the circular opening 46 and selectively fluidly connects one of the nozzle conduit section 40 and the accessory conduit section 39 with the recovery chamber 30 via the recovery tank inlet (not shown). The diverter valve 48 can be manually rotated between an accessory cleaning mode and a floor cleaning mode wherein extracted fluid can be recovered via the floor nozzle 42 through the fluid conduit 34, or from the upholstery hose 44 through the accessory conduit 39 respectively.

A tank outlet conduit 50 has an inlet (not shown) and a downwardly-oriented outlet 54 and is mounted on a rear wall 56 of the lid 26. The tank outlet conduit 50 forms an airflow path from the internal tank volume to a motor duct 58, which is in fluid communication with the motor and fan assembly 60. The lid 26 can optionally include separator baffles (not shown) for separating fluid and debris from and working airflow and creating a torturous working airflow path that inhibits fluid ingestion into the motor and fan assembly 60.

Figure 3:
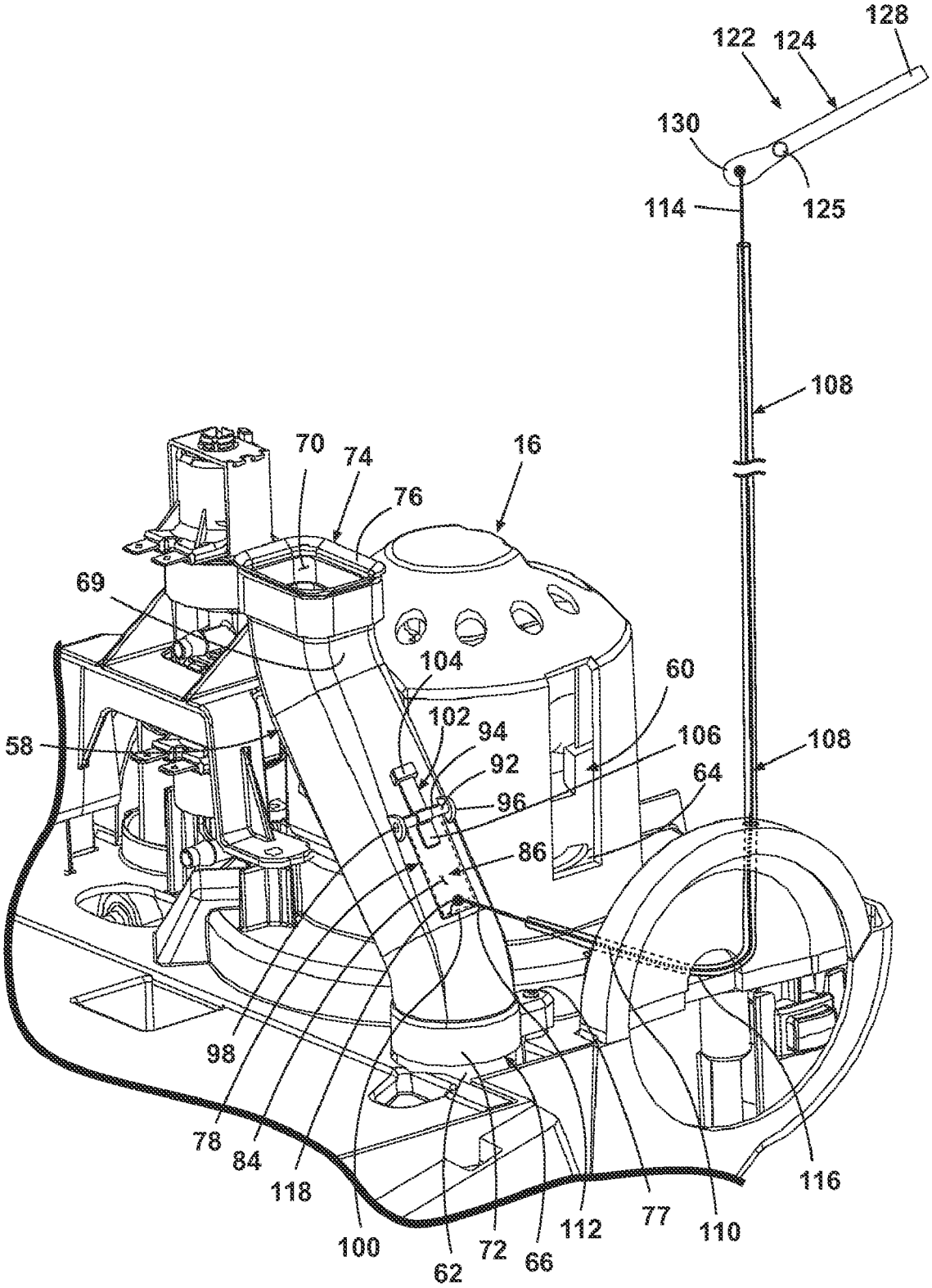
FIG. 3 is a partial perspective view of the foot assembly of FIG. 2 showing the duct door in a closed position.

Now referring to FIGS. 2-3, the base assembly 16 includes a fan assembly housing 64 extending upwardly from the bottom wall for supporting a vacuum source (not shown). A fan assembly inlet conduit 62 extends outwardly from the fan assembly housing 64 along the bottom wall and terminates at an inlet 66 for mounting the motor duct 58. Thus, the motor duct 58 fluidly connects the outlet 54 of the tank outlet conduit 50 to the motor and fan assembly 60 when the recovery tank assembly 18 is mounted to the base assembly 16. The motor duct 58 extends upwardly from the base assembly 16 and comprises an elongate hollow member having four planar sides 68, an inlet 70, and a tubular outlet 72. A resilient seal 74 surrounds the inlet 70 and comprises a flexible flange 76 that selectively mates with the tank outlet conduit 50. The motor duct outlet 72 is secured to the fan assembly inlet conduit 62 with a screw 77, but other mechanical fasteners are possible such as snaps, or the like. A ring seal (not shown) is compressed between the motor duct outlet 72 and the inlet 66 to ensure an airtight connection.

Figure 4:
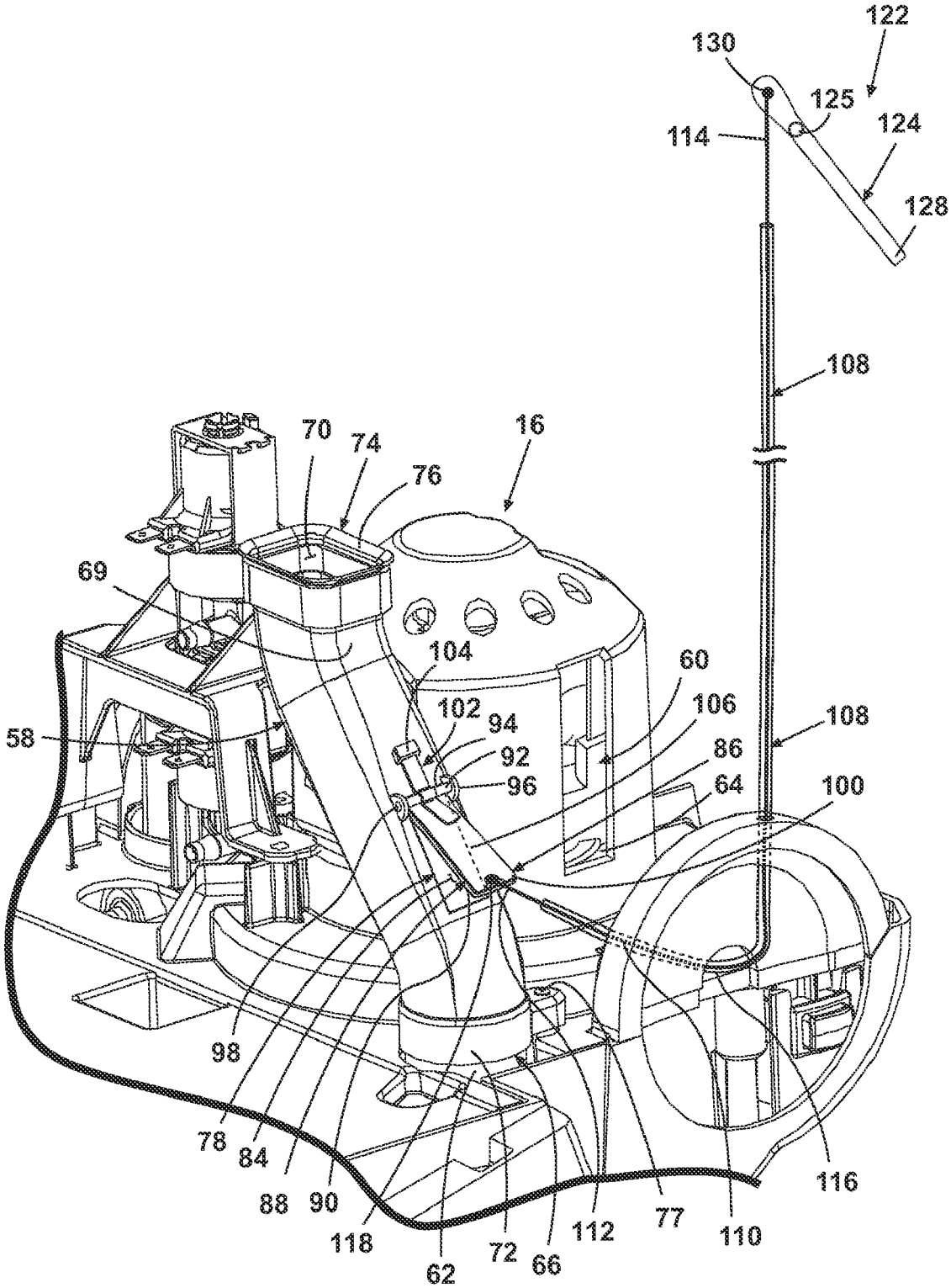
FIG. 4 is a partial perspective view of the foot assembly shown in FIG. 2 showing the duct door in an open position.

Now referring to FIGS. 3-4, the motor duct 58 further comprises a leak hole 78 positioned along an outboard planar side 69. While the leak hole 78 has been illustrated as being located on the motor duct 58, it is contemplated that the leak hole can be positioned anywhere on the working air conduit. The leak hole 78 has been illustrated as having a generally rectangular shape, although other shapes are suitable, including circular, oval or the like. The leak hole 78 can also comprise a grill or perforated screen instead of an entirely open hole. The open area of the leak hole 78 is preferably sized proportionally to the motor duct inlet 70 area such that a substantial air leak is created when the leak hole 78 is open. For example, when the leak hole 78 is open, suction lift at the floor nozzle 42 is preferably reduced by at least 50%. The leak hole area 84 is preferably greater than or equal to the area of the motor duct inlet 70 in order to provide adequate suction leakage.

A pivotally mounted duct door 86 is configured to selectively open and close the leak hole 78. The duct door 86 comprises a generally planar member with a sealing face 88 having a resilient seal 90 affixed along its perimeter for selectively sealing around the leak hole 78. Cylindrical bearing pins 92 extend outwardly along a rear edge 94 of the duct door 86 and are rotatably received within mounting ears 96 formed on the motor duct 58 on opposed sides of the leak hole 78. Each mounting ear 96 comprises a bearing hole 98 sized to permit the bearing pins 92 to rotate freely therein. The duct door 86 can thus pivot between an "open" position (FIG. 4), where a free end 100 of the duct door 86 is spaced apart from the leak hole 78, and a "closed" position (FIG. 3), where the duct door 86 is shut thereby sealing the leak hole 78. While the duct door 86 has been illustrated as being pivotally mounted to the motor duct, alternate mounting configurations, such as a slidable mounting configuration, for example, are contemplated.

A leaf spring 102 comprises a secured end 104 that is fastened to the motor duct 58 and an unsecured end 106 configured to bias the duct door 86 to the closed position. The secured end 104 can be fixed to the motor duct 58 via a commonly known fastening means such as a screw, snap, heat stake, adhesive, or other conventional fastening means. The unsecured end 106 is configured to press the duct door 86 into the "closed" position. Optionally, the spring can comprise alternate spring types such as a torsion or compression spring, or it can be omitted altogether.

The actuator 122 is connected through a mechanical connector to the duct door 86 for moving the duct door 86 between the open and closed positions. The mechanical connector can include a sheathed cable 108 that comprises an internal cable 110 having a lower end 112 and upper end 114 slidably mounted within a cable jacket 116. The lower end 112 of the internal cable 110 is connected to a pin 118 on the free end 100 of the duct door 86. The sheathed cable 108 is routed through the base assembly 16 and the upright handle assembly 14 where the upper end 114 of the internal cable 110 is operably connected to an actuator 122. For simplicity, FIG. 3 and FIG. 4 include a schematic depiction of the actuator 122. The sheathed cable 108 can be fixed in place by commonly known cable management fasteners, screws, clips, snaps, ribs, bosses, or the like.

As shown in FIG. 1, the actuator 122 may comprise a lever 124 that is pivotally mounted within a mounting bracket 126 at the side of the upright handle assembly 14. The lever comprises mounting pins 125 (FIG. 3) that are rotatably received within bearings (not shown) integral to the mounting bracket 126. A cantilever end 128 of the lever 124 extends outwardly from the mounting pins 125 and protrudes beyond the side of the upright handle 14 and is configured to be easily gripped by a user. A proximal end 130 extends inwardly from the mounting pins inside the handle and is operably connected to an upper end 114 of the internal cable 110. The lever 124 is selectively movable between "up" (FIG. 3) and "down" (FIG. 4) positions; "up" and "down" being designated with respect to upright handle 14 and corresponding to airflow through the leak hole 78 whereby when the lever 124 is in the "up" position, the duct door 86 is closed and when the lever 124 is in the "down" position, the duct door 86 is open. The mounting bracket 126 can optionally comprise conventional detent features for retaining the lever 124 in either the "up" or "down" position. Alternatively, an optional torsion spring (not shown) can be secured between the lever 124 and the mounting bracket 126, around the pins 125, to bias the lever 124 in the "up" position. In this configuration, the lever 124 can be pressed down momentarily and immediately returned to the "up" position when a user releases his or her grip on the lever 124.

Referring again to FIGS. 3-4, the proximal end 130 of the lever 124 is connected to the internal cable 110. The cable jacket 116 is retained within the base 16 and handle assembly 14, and remains stationary while the internal cable 110 is permitted to slide within the jacket 116 when it is pushed or pulled by the proximal end 130 of the lever 124. When the cantilever end 128 of the lever 124 is lifted to the "up" position as shown in FIG. 3, the mounting pins 125 rotate in the receiving bearings and the proximal end 130 moves downwardly in relation to the upright handle 14 and pushes the internal cable 110 within the jacket 116, thereby forcing the lower end 112 of the internal cable 110 to protrude out of the jacket 116. When the cantilever end 128 of the lever 124 is moved to the "down" position as shown in FIG. 4, the proximal end 130 rotates upwardly, thereby pulling the internal cable 110 and causing the lower end 112 of the internal cable 110 to retract inwardly within the cable jacket 116. Additional actuation design variations are contemplated such as substituting the pivoting lever 124 with a rotating dial or a sliding actuator.

In operation, the upright extractor 10 is prepared for use by filling the solution supply tank 20 with cleaning fluid. The upright extractor 10 is plugged into a power supply whereupon the vacuum motor and fan assembly 60 becomes energized and generates a vacuum force within the fluid recovery system. Cleaning fluid is selectively delivered to the cleaning surface via the fluid delivery system while the upright extractor 10 is moved forward and back across the cleaning surface. The agitation system is simultaneously energized to agitate the cleaning fluid into the surface to be cleaned. During normal cleaning mode, the vacuum force draws a working air flow in through the floor nozzle inlet 41, which is positioned adjacent to the cleaning surface. A working air mixture containing water, foam, cleaning solution, and dirt and debris flows through the fluid conduit 34 and recovery tank inlet (not shown), whereupon the fluid and debris are separated from the dry air and collected in the recovery chamber 30. Dry working air passes through the working air conduit and more specifically through the tank outlet 54 into the motor duct 58, and eventually into the motor and fan assembly 60, whereupon it is exhausted to atmosphere through vents (not shown) in the base assembly 16.

When extensively soiled areas are encountered, it is desirable to increase solution dwell time on the soiled surface to enhance cleaning effectiveness. Increased solution dwell time and resulting improved cleaning performance can be accomplished by temporarily interrupting suction at the floor nozzle inlet 41 to increase the dwell time of the cleaning solution on the surface to be cleaned. The extractor 10 may continue to agitate and spray without the cleaning fluid being extracted through the floor nozzle 42 during the suction interrupt.

As shown in FIG. 4, to initiate this temporary suction interrupt mode, a user grips the cantilever end 128 of the lever 124 protruding from the side of the handle 14 and pushes it to the "down" position. As the mounting pins 125 of the lever 124 rotate on bearing surfaces in the mounting bracket 126, the proximal end 130 of the lever 124 rotates upwardly and pulls the upper end 114 of the internal cable 110, retracting the lower end 112 into the cable jacket 116. As the lower end 112 of the internal cable 110 retracts, it pulls the pin 118 and rotates the free end 100 of the duct door 86 away from the leak hole 78, thereby breaking the seal between the duct door 86 and the motor duct 58 and opening the leak hole 78. The open leak hole 78 creates a substantial suction leak within the fluid recovery system between the floor nozzle inlet 41 and the motor and fan assembly inlet (not shown). This suction leak effectively interrupts the suction at the floor nozzle inlet 41 and permits the cleaning solution to dwell on the cleaning surface instead of being extracted through the floor nozzle 42.

Upon treating the surface sufficiently, as shown in FIG. 3, a user lifts the cantilever end 128 of the lever 124, returning it to the "up" position. The proximal end 130 of the lever 124 rotates downwardly and pushes the upper end 114 of the internal cable 110 so the lower end 112 of the cable 110 extends out of the jacket 116. The lower end 112 of the cable 110 pushes on the pin 118 at the free end 100 of the duct door 86 and returns it to the closed position thus re-sealing the leak hole 78 and restoring full suction to the floor nozzle 42. The leaf spring 102 and negative pressure inside the motor duct 58 also tend to bias the duct door 86 back to its sealed/closed position.

Figure 5:
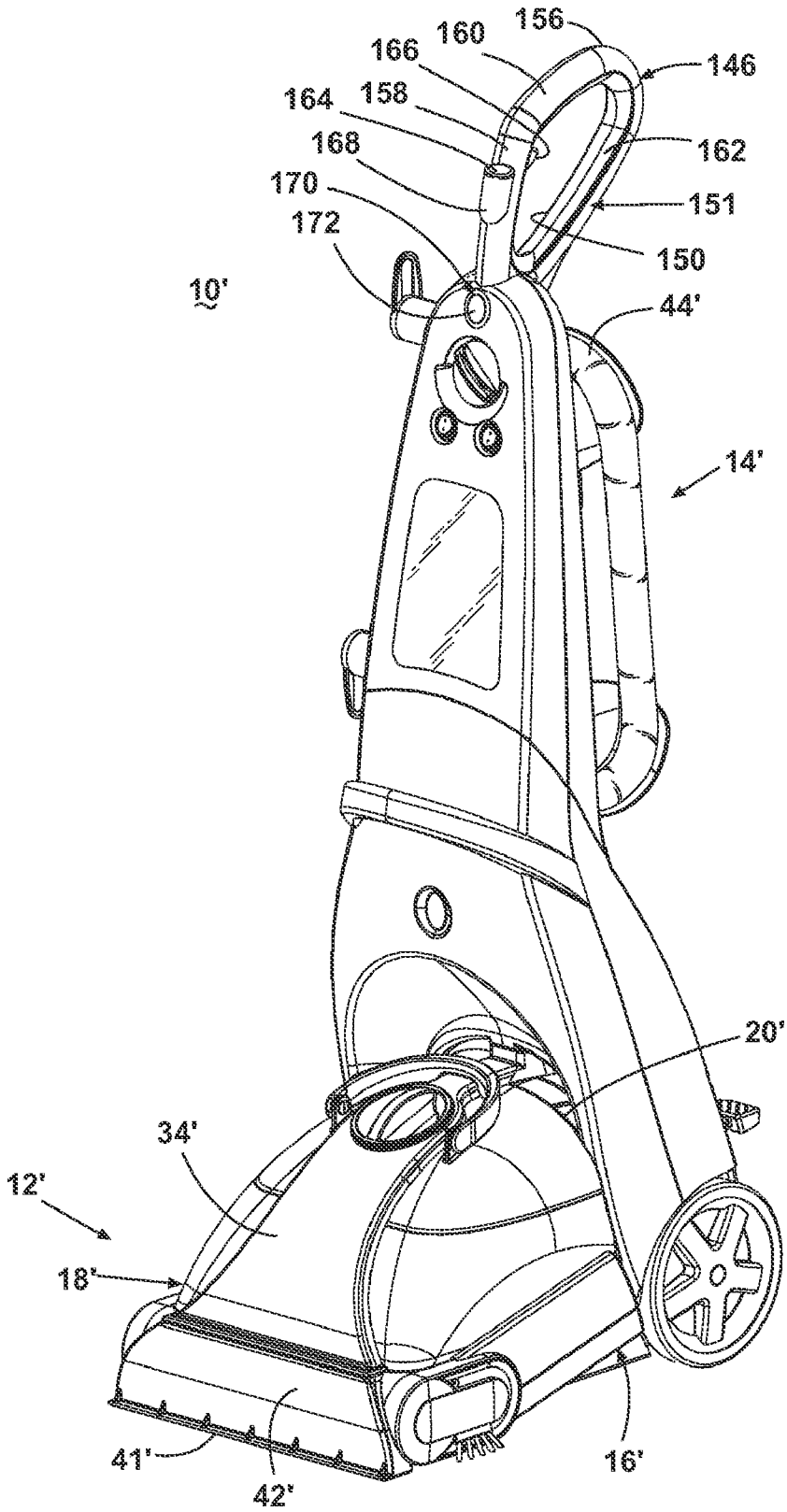
FIG. 5 is a front perspective view of an upright extractor according to a second embodiment of the invention.
Figure 6:
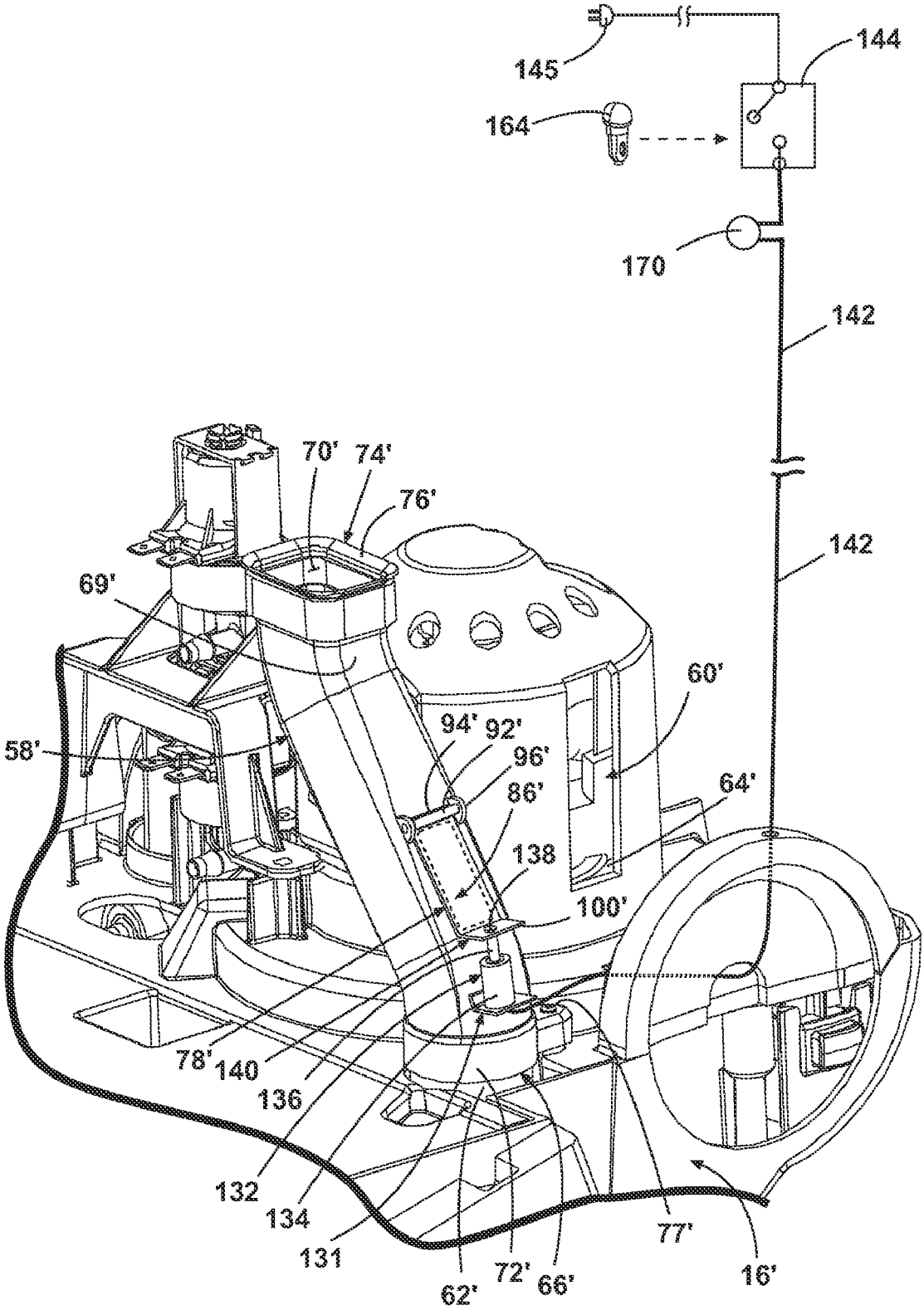
FIG. 6 is a partial perspective view of the foot assembly shown in FIG. 5 showing the duct door in a closed position.

Referring to FIGS. 5-6, in a second embodiment of the invention where like elements from the first embodiment are identified with the same reference numerals and include a prime (') symbol, the actuator 122' is connected through an electrical connector to the duct door 86' for moving the duct door 86' between the open and closed positions. The electrical connector can include a small electromechanical solenoid piston 132 secured to a mating recess 131 formed in the lower portion of the motor duct 58'. The solenoid piston 132 is of conventional design and comprises a stationary housing 134 having an inductive coil (not shown) mounted therein, connected to a power supply, and configured to surround a cylindrical piston 136. The solenoid piston 132 is selectively movable between a vertically extended position and a retracted position when the inductive coil is alternately energized and de-energized. A leading end 138 of the piston is operably connected to the bottom side of an angled flange 140 on the free end 100' of the duct door 86'. Electrical conductor leads 142 extend from the solenoid piston 132, routing through the base assembly 16', through the upright handle assembly 14', and are connected to a momentary micro-switch 144 housed in a cavity within an upright handle grip 146. The momentary micro-switch 144 is, in turn, connected to a line power source 145 to selectively energize the solenoid piston 132. Alternatively, the momentary micro-switch 144 can be replaced by a conventional toggle or "rocker" switch (not shown) as is commonly known in the art.

Referring to FIGS. 5-6, the handle grip 146 is mounted to an upper portion of the handle 14' and facilitates movement of the upright extractor 10' by the user across a surface to be cleaned. The grip 146 is formed by two mating halves 150, 151 and comprises a stem (not shown) for mounting the grip 146 to the upper portion of the handle 14'. The grip 146 portion comprises an enclosed loop that is generally triangular in shape having arcuate corners 156. The grip 146 portion is formed by a generally vertical, upright section 158 joined at an obtuse angle to one end of an upwardly and rearwardly extending hand section 160 and a connecting section 162 that connects an opposite end of the hand section to the upright section 158 at the stem (not shown). The handle grip 146 further comprises a push button 164 and a trigger button 166 secured between the mating halves 150, 151. The push button 164 is slidably mounted within a pocket 168 formed on a front side of the upright section 158 for easy manipulation by a thumb of the user. A suitable push button and micro-switch configuration has been disclosed previously in published US 2008/0196193 A1, which is incorporated herein by reference in its entirety.

The push button 164 is operatively coupled to the momentary micro-switch 144 that is electrically coupled to the solenoid piston 132 via electrical leads 142 routed through the handle 14' and base assembly 16'. The trigger button 166 is positioned at a rear side of the upright section 158 for easy manipulation by a trigger finger of a user. The trigger 166 is operably connected to a second micro-switch (not shown) that is operably coupled to the fluid distributor (not shown) for distributing cleaning fluid onto the surface to be cleaned.

An optional indicator light 170 is mounted to upper portion of the handle 14' for indicating when the suction at the floor nozzle 42' has been interrupted. The indicator light 170 can be selected from known constructions, including light emitting diodes (LED) or incandescent lamps, for example. The indicator light 170 is of conventional construction and comprises a lens 172, a light emitting element (LED) (not shown), and electrical leads 142 connected in series with the momentary micro-switch 144 and solenoid piston 132.

As previously described, and shown in schematic form in FIG. 6, the momentary micro-switch 144 is operatively coupled to the push button 164 such that it becomes selectively engaged when a user slidably engages the push button 164. The indicator light 170 is preferably mounted to the upper portion of the handle 14' or the vertical, upright section 158 of the hand grip 146 such that the lens 172 is easily viewable by a user during use.

In operation, the upright extractor 10' is prepared for use as previously described and likewise functions in normal cleaning mode as previously described. When extensively soiled areas are encountered and a user desires to pre-treat a heavily soiled area by increasing solution dwell time, a user depresses the push button 164 with her thumb, which actuates the momentary micro-switch 144. The momentary micro-switch 144 closes the circuit containing the solenoid piston 132 and indicator light 170, thereby energizing both components simultaneously. When energized, the solenoid piston 132 extends and the leading end 138 of the cylindrical piston 136 pushes the angled flange 140 upwardly. The duct door 86' is pushed away from the leak hole 78' in the motor duct 58', thus creating a substantial suction leak within the fluid recovery system between the floor nozzle inlet 41' and the motor and fan assembly 60'. The suction leak effectively interrupts the suction at the floor nozzle inlet 41' and permits the cleaning solution to dwell on the cleaning surface instead of being extracted through the floor nozzle 42'. The indicator light 170 illuminates when the solenoid piston 132 becomes energized and indicates that suction at the floor nozzle 42' has been interrupted. Upon treating the surface sufficiently, the user releases the push button 164, the momentary micro-switch 144 returns to its normally open position thereby opening the circuit and de-energizing both the solenoid piston 132 and indicator light 170. The solenoid piston 132 retracts to its compressed position and pulls the angled flange 140 downwardly returning the duct door 86' to its closed position thus sealing the leak hole 78' and restoring full suction to the floor nozzle 42'. The indicator light 170 simultaneously shuts off to indicate that suction to the floor nozzle 42' has been restored and that normal functional operation of the upright extractor 10' has resumed.

Figure 7:
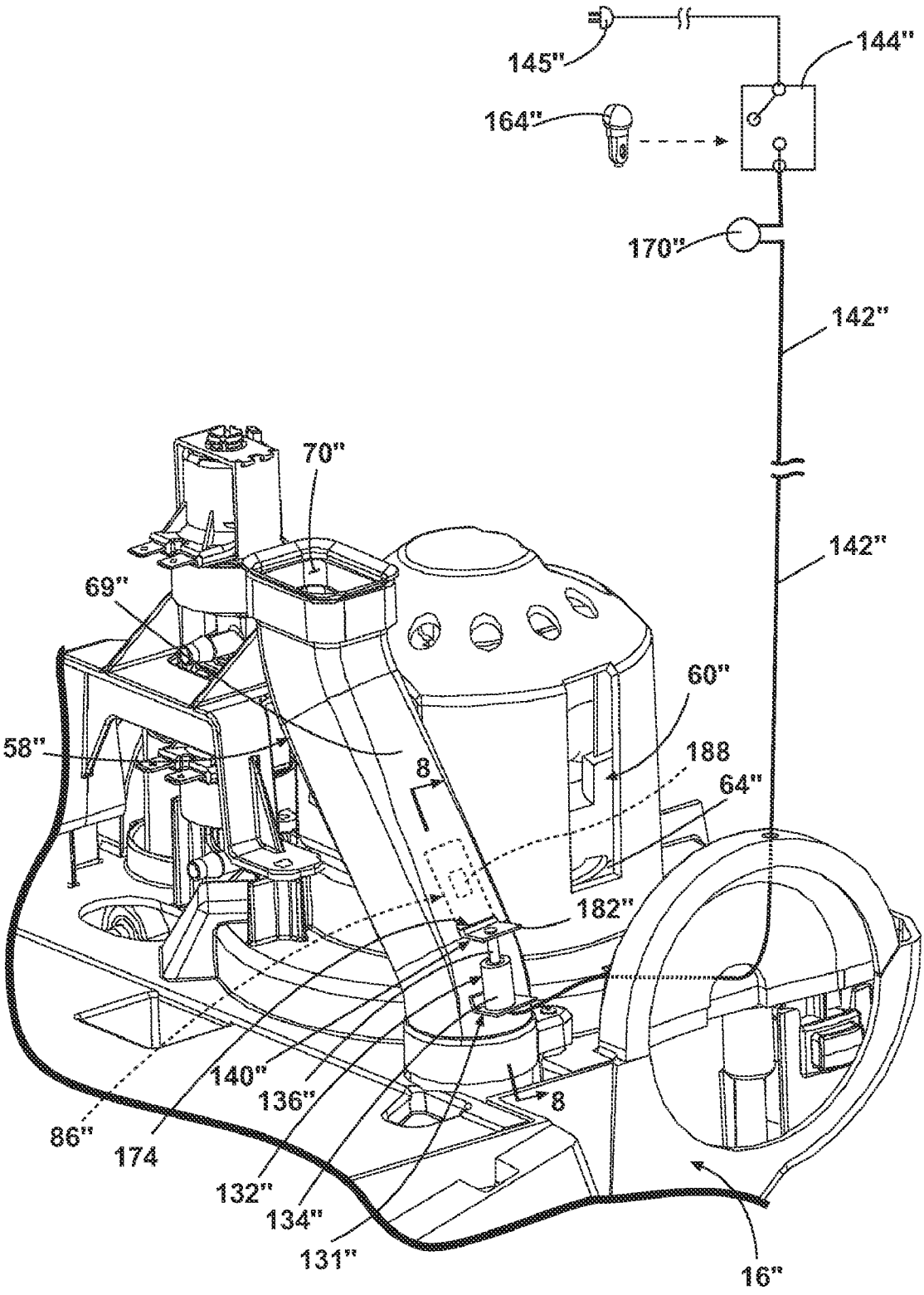
FIG. 7 is a partial perspective view of the foot assembly according to a third embodiment of the invention.
Figure 8:
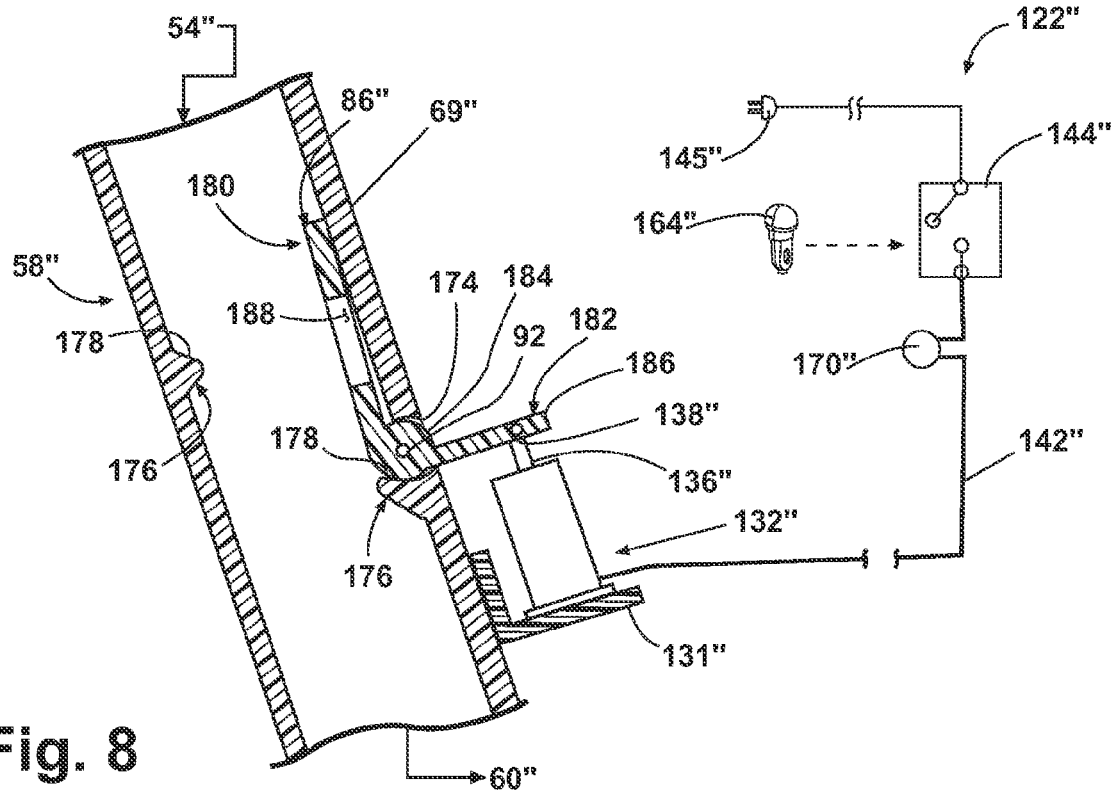
FIG. 8 is a partial sectional view taken along line 8-8 of FIG. 7 showing the duct door in an open position.
Figure 9:
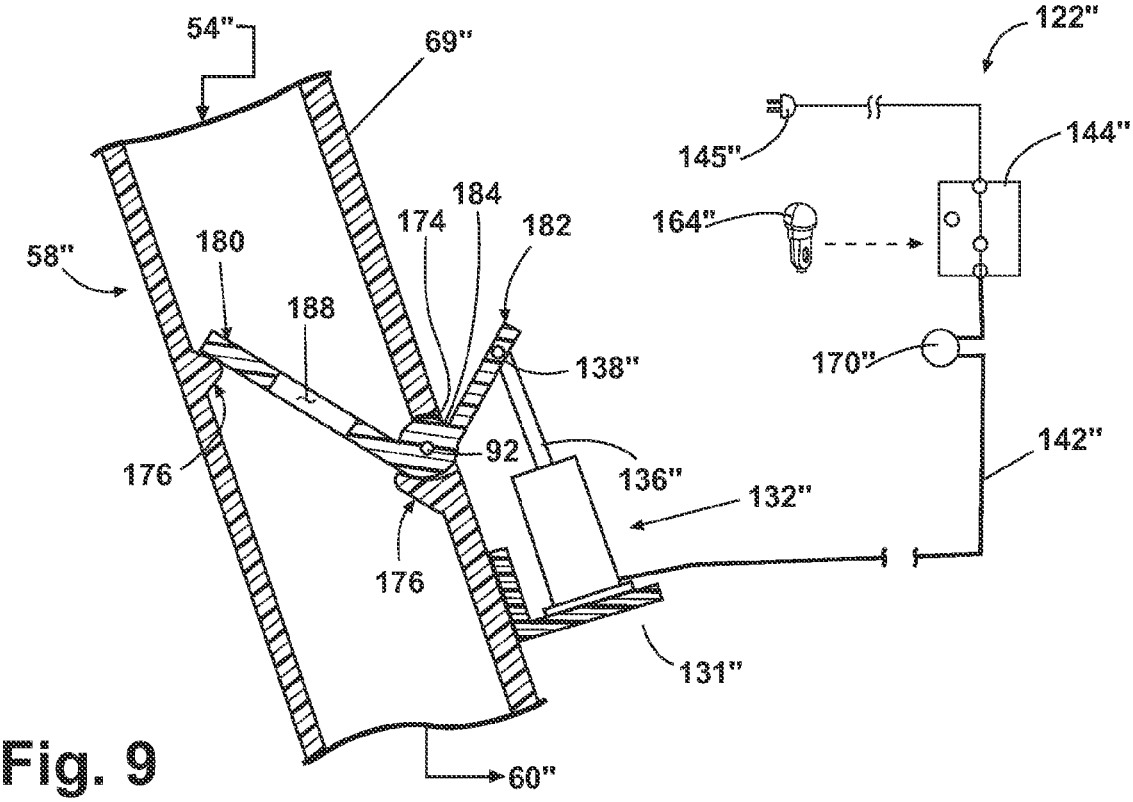
FIG. 9 is a partial sectional view taken along line 8-8 of FIG. 7 showing the duct door in a closed position.

Now referring to FIGS. 7-9, which include a schematic depiction of a third embodiment of the invention where like elements from the second embodiment are identified with the same reference numerals and include a double prime (") symbol, the motor duct 58" forms a portion of the working air conduit between the recovery tank outlet 54" and the motor and fan assembly 60" inlet. The motor duct 58" comprises a rectangular slot 174 in the outboard planar side 69" and mounting ears (not shown) formed inside the slot 174 pivotally receive bearing pins 92" that extend from an inwardly pivoting duct door 86". The motor duct 58" further comprises at least one sealing lip 176 protruding from the inner surface of the motor duct along a generally horizontal reference plane. The sealing lip 176 can also be formed along an inclined or declined plane depending on various design constraints. The sealing lip 176 comprises an upwardly facing flat sealing surface 178 configured to selectively seal against the bottom of the inwardly pivoting duct door 86". Two sealing lips 176 have been illustrated in FIGS. 8 and 9.

The inwardly pivoting duct door 86" comprises a generally L-shaped member having an inner leg 180 and an outer leg 182 that are connected at a pivot portion 184. Bearing pins 92" extend outwardly from the pivot portion 184 along the pivot axis. The inner leg 180 is configured to be pivotally mounted within the motor duct 58" while the outer leg 182 is configured to remain outside the motor duct 58". A distal end 186 of the outer leg 182 is operably connected to an actuator 122" via either a mechanical or electrical connector as previously disclosed. The inner leg 180 further comprises a small restriction orifice 188 having an open area less than any portion of the upstream working air conduit, including the motor duct inlet 70". The inwardly pivoting duct door 86" is configured to pivot between an "open" position where the inner leg 180 is parallel to the outboard planar side 69" of the motor duct 58" and a "closed" position where the inner leg 180 is rotated inwardly to span across the motor duct 58" interior.

When the inner leg 180 is in the "open" position, the motor duct 58" and, thus, the working air conduit are unobstructed. When the inner leg 180 is in the "closed" position, the motor duct 58" and working air conduit are partially obstructed by the inwardly pivoting duct door 86". When the inner leg 180 is in the "closed" position, the working airflow may only flow through the restriction orifice 188, which significantly reduces the working airflow within the working air conduit. In turn, the restriction orifice 188 reduces the working airflow into the motor and fan assembly 60" and this results in a reduced suction upstream of the restriction orifice 188. Accordingly, when the inner leg 180 is in the "closed" position, the floor nozzle inlet 41" adjacent to the cleaning surface also has reduced suction.

The distal end 186 of the outer leg 182 can be operably connected to an actuator 122" via an electrical or mechanical connector as described in previous embodiments. The electrical connector will be described herein, although a mechanical connector as previously disclosed is also contemplated. In the electrical connector, a conventional solenoid piston 132" operably connects the distal end 186 of the outer leg 182 to the actuator 122" for pivoting the duct door 86" between the "open" and "closed" positions. The solenoid piston 132" has been previously described and comprises a cylindrical piston 136" that is selectively movable between a vertically extended position when the solenoid piston 132" is energized (FIG. 9) and a retracted position when the solenoid piston 132" is de-energized (FIG. 8). Electrical conductor leads 142" extend from the solenoid piston 132", through the base assembly 16", through the upright handle assembly 14", and are connected to the actuator 122" as previously described. The actuator 122" comprises a momentary micro-switch 144" housed within the upright handle grip 146" and connected to a line power source 145" to selectively energize the solenoid piston 132". A push button 164" is slidably mounted on the handle grip 146" and is operatively coupled to the momentary micro-switch 144" such that the switch becomes selectively engaged when a user slidably engages the push button 164". An optional indicator light 170" can also be included in the circuit as previously described. The indicator light 170" is preferably mounted to the upper portion of the handle 14" and positioned to be easily viewed by a user.

While the restriction orifice 188 has been illustrated as being located on a pivoting duct door 86" mounted within the motor duct 58", it is contemplated that the restriction orifice 188 can be positioned anywhere within the working air conduit and can be incorporated on a slidably mounted duct door, for example. Further, although the restriction orifice has been illustrated as a single orifice it has been contemplated that multiple restriction orifices could be used so long as the combined area of the restriction orifices have a combined open area less than any portion of the upstream working air conduit, including the motor duct inlet 70".

In operation, when extensively soiled areas are encountered and a user desires to pre-treat a heavily soiled area by increasing solution dwell time, a user depresses the push button 164", which actuates the momentary micro-switch 144". The momentary micro-switch 144" closes the circuit containing the solenoid piston 132" and indicator light 170", thereby energizing both components simultaneously. When energized, the solenoid piston 132" extends and the leading end 138" of the cylindrical piston 136" pushes the distal end 186 of the outer leg 182 upward causing the inner leg 180 of the duct door 86" to pivot inwardly to a "closed" position.

In the "closed" position, the inner leg 180 of the inwardly pivoting duct door 86" spans across the motor duct 58" interior, the bottom perimeter surface of the inner leg 180 rests on the sealing lip 176, and the restriction orifice 188 restricts the working airflow within the working air conduit. While in the "closed" position, suction in the working air conduit upstream from the restriction is significantly reduced. The reduced suction permits the cleaning solution to dwell on the cleaning surface instead of being extracted through the floor nozzle 42". The indicator light 170" illuminates when the suction at the floor nozzle 42" has been restricted. Upon treating the surface sufficiently, the user releases the push button 164", the momentary micro-switch 144" returns to its normally open position thereby opening the circuit and de-energizing both the solenoid piston 132" and indicator light 170". The solenoid piston 132" retracts to its compressed position and pulls the distal end 186 of the outer leg 182 downward returning the duct door 86" to its "open" position where the inner leg 180, including the restriction orifice 188 is rotated upward such that it is parallel to the outboard planar side 69" of the motor duct 58". Thus, the restriction is removed and full suction to the floor nozzle 42" is restored. The indicator light 170" simultaneously shuts off to indicate that suction to the floor nozzle 42" has been restored.

Figure 10:
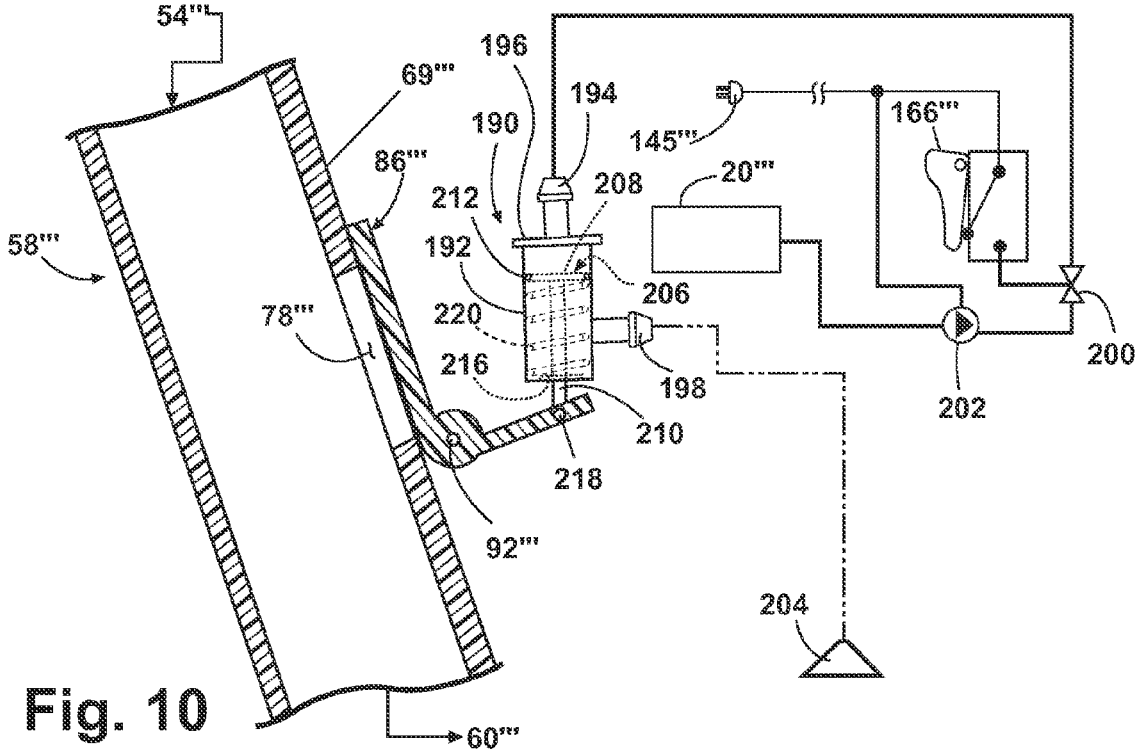
FIG. 10 is a partial sectional view according to a fourth embodiment of the invention.
Figure 11:
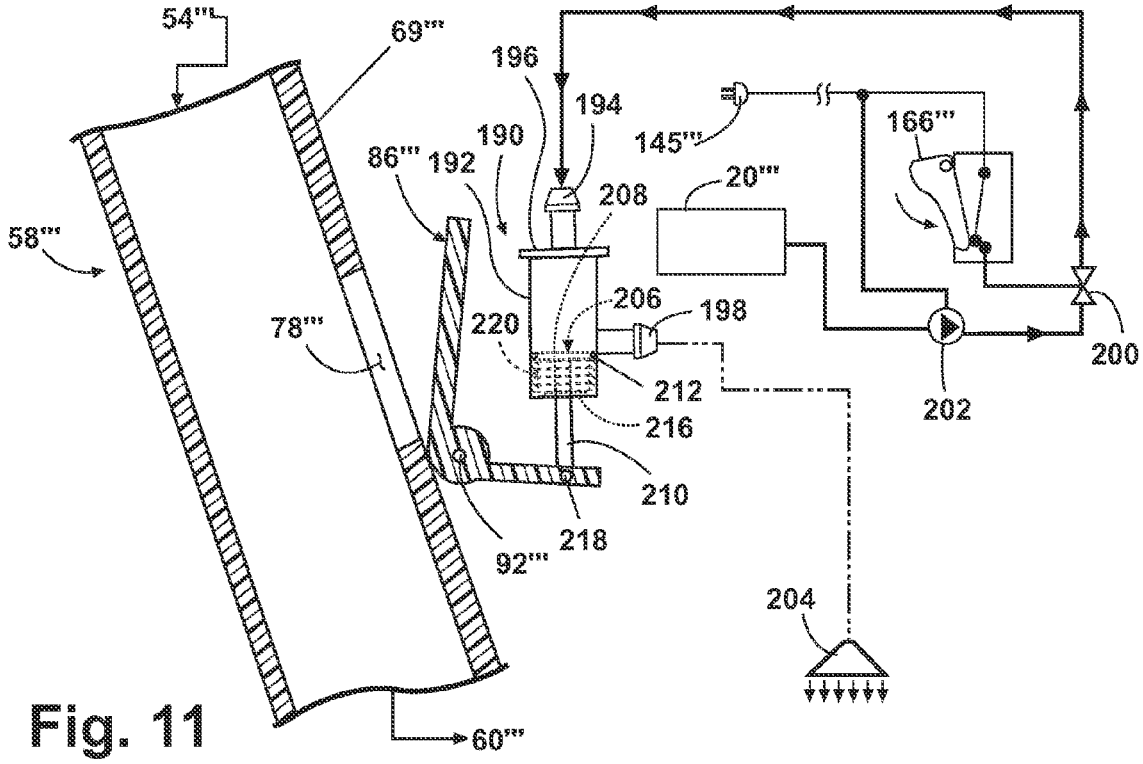
FIG. 11 is a partial sectional view also according to the fourth embodiment of the invention.

Now referring to FIGS. 10 and 11, which show a partial depiction of a fourth embodiment of the invention where like elements from previous embodiments are identified with the same reference numerals and include a triple prime (''') symbol. Here, the duct door 86''' is operably connected to the fluid delivery system via a hydraulic connector such that when fluid is applied to the cleaning surface via the fluid distributor, the hydraulic connector moves the duct door 86''' to interrupt suction at the floor nozzle inlet (not shown). The hydraulic connector includes a hydraulic cylinder 190 that comprises a cylindrical barrel 192 having an axial inlet port 194 on a proximal end 196 and an outlet port 198 extending radially from a distal end of the barrel 192. The inlet port 194 is fluidly connected to the fluid supply tank 20''' via conventional tubing and fluid fittings. A valve 200 and an optional pump assembly 202 are positioned between the fluid supply tank 20''' and the inlet port 194 for selectively controlling fluid delivery into the hydraulic cylinder 190. The outlet port 198 is fluidly connected to the fluid distributor, which can include one or more spray nozzles 204. The valve 200, located between the pump 202 and the hydraulic cylinder 190, is operably connected to the trigger 166''' that is pivotally mounted within the handle grip 146''' for manipulation by a user. The trigger 166''' is configured to selectively engage the valve 200 via conventional mechanical means such as a piston rod, or conventional electrical means such as a micro-switch and conductor wires, for example.

A plunger piston 206 is configured to slide axially within the barrel 192 between an open and closed position. The plunger piston 206 comprises a cylindrical plunger head 208 connected to a proximal end of a piston rod 210. The perimeter of the plunger head 208 is surrounded by an annular seal 212 that is configured to seal against the interior surface of the barrel 192 to prevent fluid leakage therebetween. A distal end of the piston rod 210 is slidingly supported by an internal bearing 216 mounted at the distal end of the barrel 192. The distal end of the piston rod further comprises an eye 218 that is adapted for connection to the duct door 86'''. An optional compression spring 220 is seated between the backside of the plunger head 208 and the distal end of the barrel 192 to bias the plunger piston 206 towards the inlet port 194 in its closed position. In the closed position, the spring 220 forces the plunger head 208 towards the inlet port 194, thereby blocking the fluid flow path to the outlet port 198 and retracting the piston rod 210 within the barrel 192. In the open position, the plunger head 208 is pushed towards the distal end of the barrel 192, thereby opening the fluid flow path between the inlet and outlet ports 194, 198 and extending the piston rod 210 so the distal end protrudes outwardly from the barrel 192. As previously described, the duct door 86''' is configured to open, which creates an air leak through the leak hole 78''' within the working air conduit, or to close wherein the leak hole 78''' is covered. Further, similar to the disclosure above, it has also been contemplated that the duct door 86''' can be operably connected to the distal end of the piston rod 210 in such a way that the duct door 86''' creates a restriction upstream from the vacuum motor/fan assembly 60'''.

In operation, the upright extractor 10''' is prepared for use by filling the solution supply tank assembly 20''' and energizing the unit as previously described. Power is subsequently delivered to the vacuum motor/fan assembly 60''' and fluid pump 202, thereby drawing a vacuum on the fluid recovery system and pressurizing cleaning fluid within the fluid delivery system. A user depresses the trigger 166''' on the handle grip 146''' to dispense cleaning fluid onto the cleaning surface. The trigger 166''' actuates the valve 200 downstream from the fluid pump 202. When the valve 200 is opened, fluid flows through the valve 200 and into the inlet port 194 of the hydraulic cylinder 190. The fluid contacts the plunger head 208 and pushes the plunger piston 206 away from the inlet port 194 and compresses the spring 220 seated behind the plunger head 208. The plunger head 208 is eventually forced past the outlet port 198, thus opening the fluid flow path between the inlet port 194 and the outlet port 198 and allowing fluid to flow freely there through. The fluid then flows into the fluid distributor where it is then delivered to the cleaning surface through one or more spray nozzles 204. As the plunger piston 206 is forced towards the distal end of the barrel 192, the piston rod 210 slides axially through the internal bearing 216 and protrudes outwardly from the distal end of the barrel 192. The distal end of the piston rod 210 containing the eye 218 moves the duct door 86' to create either an air leak or restriction within the working air conduit upstream of the vacuum motor/fan assembly 60 as previously described. The eye 218 moves the duct door 86" to create an air leak in FIG. 11. Accordingly, suction upstream from the vacuum motor/fan assembly 60''', including suction at the floor nozzle inlet 41''' can be interrupted or restricted simultaneously as cleaning liquid is applied, thereby permitting the liquid to dwell on the cleaning surface and enhance cleaning performance.

When the trigger 166''' is released, the valve 200 closes and stops the fluid flow into the inlet port 194 of the hydraulic cylinder 190. The spring 220 behind the plunger head 208 forces the plunger head 208 towards the inlet port 194, thereby blocking the fluid flow path to the outlet port 198 and retracting the piston rod 210 within the barrel 192. The piston rod 210 slides axially through the internal bearing 216 and the eye 218 pulls the duct door 86' to its closed position restoring airflow in the working air conduit. Accordingly, suction upstream from the vacuum motor/fan assembly 60''', including suction at the floor nozzle inlet 41''' is restored.

While the invention has been specifically described in connection with certain specific embodiments thereof, it is to be understood that this is by way of illustration and not of limitation. For example, the invention has been described with reference to an upright extractor. The invention is equally applicable to a canister extractor has a solution tank, a pump, a suction source and a recovery tank mounted in the canister, a hose extending from the canister, a wand with a handle at one end connected to the hose and a suction nozzle on the other end, and an actuator on the handle. In this embodiment, the opening can be on the wand, the duct door can be slidably mounted on the wand and the actuator can be mounted directly on the door. Thus, reasonable variation and modification are possible within the foregoing description and drawings without departing from the spirit of the invention, which is described in the appended claims.

What is claimed is:

1. An extractor comprising:

a fluid delivery system including a solution supply tank assembly, a fluid distributor, and a conduit between the fluid tank and the fluid distributor for depositing fluid onto a surface to be cleaned;

a fluid recovery system including a floor suction nozzle, a recovery tank assembly, a suction source having a suction inlet fluidly connected to the recovery tank and the suction nozzle through a working air conduit and adapted to draw liquid through the suction nozzle and deposit the liquid in the recovery tank, and having a suction source outlet;

a duct door moveably mounted to the working air conduit for movement between a first position at which normal suction at the suction nozzle is reduced and a second position at which normal suction at the suction nozzle is unreduced;

an actuator connected to the duct door for selectively moving the duct door between the first position and second position;

wherein the duct door is positioned downstream of the recovery tank in the working air conduit and upstream of the motor inlet.

2. The extractor of claim 1 wherein a leak hole is located in the working air conduit; and the duct door covers the leak hole in the second position and uncovers the leak hole in the first position at which air is vented into the working air conduit, thereby at least partially interrupting suction at the surface.

3. The extractor of claim 2 wherein the duct door comprises a generally planar member having a resilient seal affixed along a perimeter to fluidly seal the leak hole when the duct door is in the second position.

4. The extractor of claim 1 wherein the duct door has a restriction orifice and is moveably mounted inside the working air conduit for movement between the first position in which the duct door spans across the working air conduit interior and the airflow through the working air conduit is restricted and the second position in which airflow is unrestricted.

5. The extractor of claim 4 and further comprising a sealing lip between an inner surface of the working air conduit and the duct door to seal the duct door against the working air conduit when the duct door is in the first position.

6. The extractor of claim 1 wherein the extractor is an upright extractor and further comprises a foot assembly for movement along the surface to be cleaned and a handle assembly pivotally mounted to the foot assembly for directing the foot assembly along the surface to be cleaned.

7. The extractor of claim 6, wherein the actuator is at least partially located on the handle assembly and the suction source is mounted in the foot assembly.

8. The extractor of claim 1 wherein the actuator is connected through an electrical connector to the duct door for moving the duct door between the first and second positions.

9. The extractor of claim 8 wherein the electrical connector comprises a solenoid coupled to the duct door and configured to selectively move the duct door between the first and second positions.

10. The extractor of claim 1 wherein the actuator is connected through a mechanical connector to the duct door for moving the duct door between the first and second positions.

11. The extractor of claim 10 wherein the mechanical connector comprises a cable connected to the actuator and the duct door.

12. The extractor of claim 1 wherein the actuator is connected through a hydraulic connector to the duct door for moving the duct door between the first and second positions.

13. The extractor of claim 12 wherein the hydraulic connector comprises a hydraulic cylinder operably coupled to the duct door and configured to selectively move the duct door between the first and second positions.

14. The extractor of claim 13, wherein the conduit between the fluid tank and the fluid distributor includes the hydraulic cylinder which is adapted to fluidly couple the solution supply tank to the fluid distributor when the duct door is in the first position and to interrupt the flow of fluid from the fluid tank to the fluid distributor when duct door is in the second position.

15. The extractor of claim 1 and further comprising an indicator to alert a user when the duct door is in the first position.

16. The extractor of claim 15 wherein the indicator is a visual signal.

* * * * *